US005595361A

United States Patent [19]

Remington et al.

[11] Patent Number: 5,595,361

[45] Date of Patent: Jan. 21, 1997

[54] WING RAIL HOLD-DOWN

[75] Inventors: James A. Remington, Superior, Wis.; Keith Young, Naperville; Stephen R. Kuhn, Richton Park, both of Ill.

[73] Assignee: ABC Rail Products Corporation, Chicago, Ill.

[21] Appl. No.: 561,568

[22] Filed: Nov. 22, 1995

[51] Int. Cl.[6] ..... B61K 13/00

[52] U.S. Cl. ..... 246/276; 246/391

[58] Field of Search ..... 246/276, 382, 246/383, 384, 385, 386, 387, 388, 389, 390, 391, 392, 275, 468, 469, 470, 471, 472, 454, 463, 462, 457, 458, 455, 456, 443, 449, 453; 238/310, 381, 314, 336, 338

[56] References Cited

U.S. PATENT DOCUMENTS

| | | | |
|---|---|---|---|
| 1,284,559 | 11/1918 | Barrett | 246/276 |
| 1,577,672 | 3/1926 | Almquist | 246/391 |
| 2,110,633 | 3/1938 | Pikarchuk et al. | 246/276 |

*Primary Examiner*—Mark T. Le

*Attorney, Agent, or Firm*—Thomas S. Baker, Jr.

[57] ABSTRACT

A railroad trackwork spring frog installation having a conventional wing rail with attached wing rail horn fitting is provided with an improved co-operating hold-down comprising a weld block element component, a separate, readily replaceable, riser component supported by the weld block component, a housing component positioned over the wing rail horn fitting and supported by the weld block component, and bolt-type fastener devices joining the hold-down components into a unitary structure.

6 Claims, 3 Drawing Sheets

WING RAIL HOLD-DOWN

FIELD OF THE INVENTION

This invention relates generally to railroad trackworks, and particularly concerns an improved wing rail hold-down which may be advantageously utilized in connection with railroad trackwork spring frog installations.

BACKGROUND OF THE INVENTION

Various different forms of forged steel hold-downs are utilized in the rail transportation industry for the purpose of properly guiding the wing rail and attached horn fitting components of trackwork spring frog installations during their frequent lateral displacement in the course of normal spring frog installation operations. Spring frog installation operation over prolonged time causes excessive wear of certain restraint surfaces in the known hold-down assemblies, and leads to the necessity of having to either make substantial hold-down assembly repairs or sometimes replacing the complete assembly. Such remedial actions are labor intensive, are time-consuming, and are quite difficult to undertake and accomplish if rail traffic over the spring frog installation is particularly heavy.

We have discovered that the maintenance shortcomings of the known wing rail hold-down constructions may be readily overcome by incorporating the improved wing rail hold-down of our invention into a trackwork spring frog installation and yet provide for the proper guidance of the co-operating wing rail and attached horn fitting components during spring frog operation.

Other objectives and advantages of our invention will become apparent from consideration of the summary, descriptions, drawings, and claims which follow.

SUMMARY OF THE INVENTION

In order to achieve the objects of our invention and yet properly guide the wing rail and attached horn fitting components of a railroad trackwork spring frog installation during utilization, we provide a wing rail hold-down assembly with a novel, two-piece riser block component, with a cast hold-down housing component that co-operates with and is supported by the novel two-piece riser block component, and with bolt-type fastener components that join the riser block and hold-down housing components into a unitary structure following their proper engagement with the wing rail horn fitting. The novel two-piece riser block is comprised of a weld block element and a separate, readily-removable, and readily-replaceable riser element that is supported by the weld block element. The assembly cast hold-down housing component is provided with downward-depending leg elements.

The assembly weld block element is normally factory-welded to the spring frog base plate, the readily replaceable riser element is slipped into a position which is intermediate the weld block element and the spring frog wing rail and attached horn fitting components, the removable bolt-type fastener devices are engaged with retention slots provided in the weld block element, the cast hold-down housing element is engaged with the horn fitting and with the previously-placed bolt fasteners, and the bolt fastenings completed.

In use the novel hold-down assembly may be readily disassembled for purposes of removing and replacing either or both the assembly riser element and the cast housing component if such are deemed excessively worn as a result of prolonged spring frog installation operation. Such removal and replacement can readily be accomplished without the necessity of removing the wing rail horn fitting component from the wing rail.

DETAILED DESCRIPTION

Figure 1:
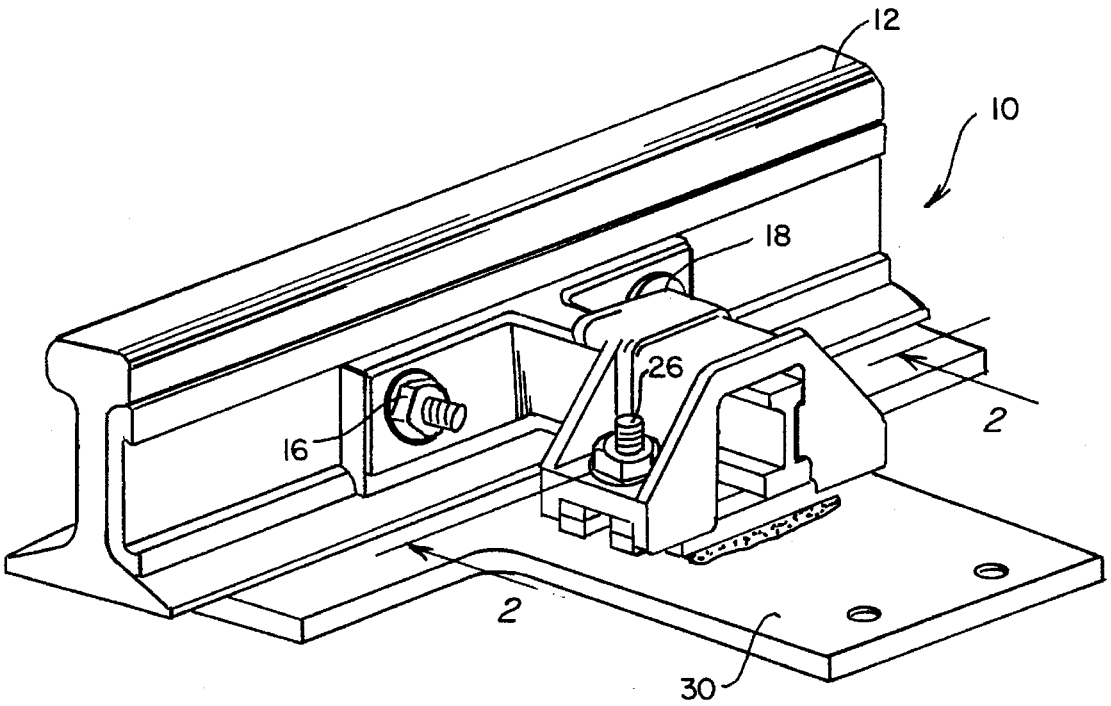
FIG. 1 is perspective view of a preferred embodiment of the wing rail hold-down of the present invention.
Figure 2:
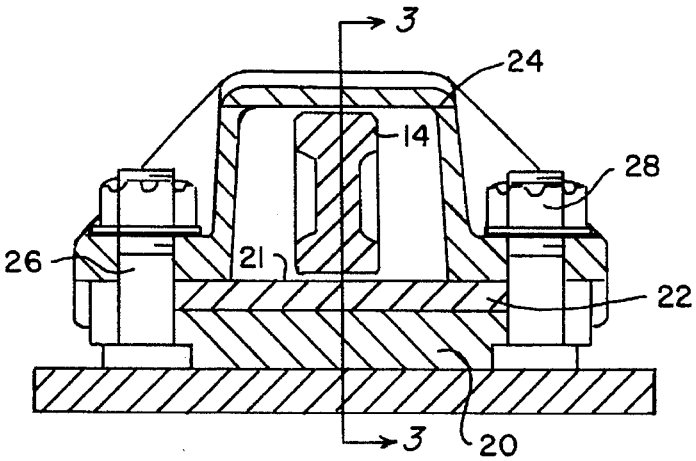
FIG. 2 is a partially-sectioned elevation view taken along line 2—2 of FIG. 1.

FIG. 1 illustrates in perspective a portion of a railroad trackwork spring frog installation 10 which incorporates the improved wing rail hold-down of the present invention. Installation 10 includes a laterally movable wing rail component 12 having a conventional horn fitting 14 attached to its web by the bolt fasteners designated 16 and 18. In a typical trackwork spring frog installation the laterally movable wing rail, sometimes referred to as a spring wing, is provided with multiple horn fittings which are spaced-apart throughout the laterally moved portion of the spring wing.

Each wing rail hold-down preferably is comprised of a weld block component 20, a readily removable and replaceable riser component 22, a cast hold-down housing component 24, and a pair of readily removable bolt-type fastener components 26 and 28 that function to join the components of the hold-down assembly into a unitary structure.

Figure 3:
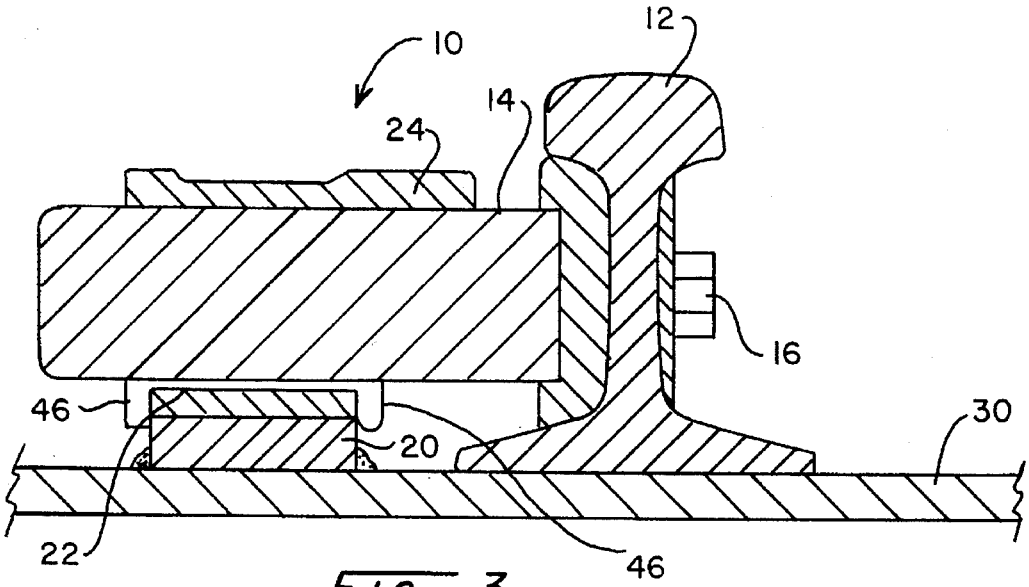
FIG. 3 is a cross-sectional view taken along line 3—3 of FIG. 2.
Figure 4:
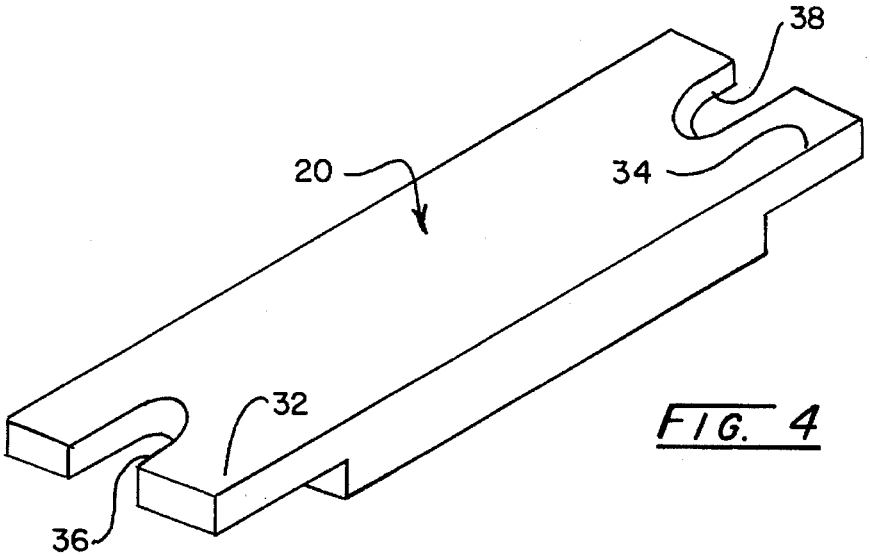
FIG. 4 is an orthographic view of the weld block component illustrated in FIGS. 1 through 3.
Figure 5:
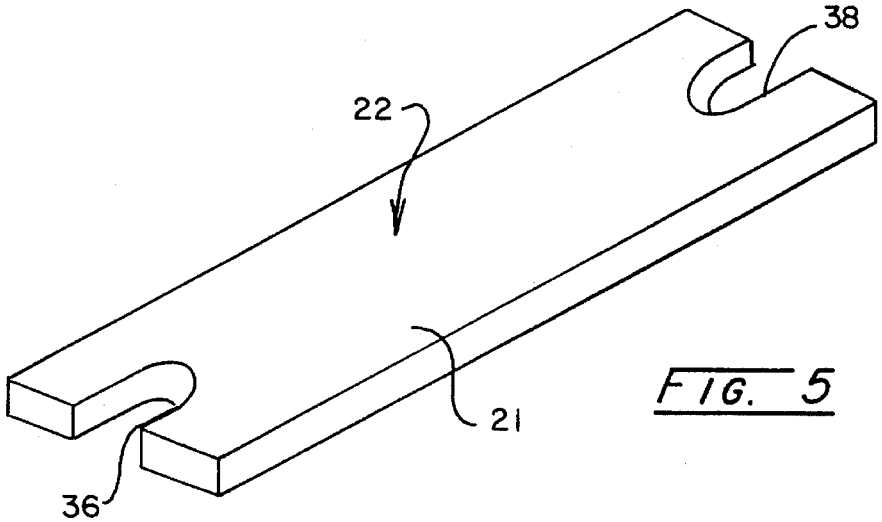
FIG. 5 is an orthographic view of the replaceable riser component illustrated in FIGS. 1 through 3.

Weld block component 20 must be properly located before being welded to base spring frog plate 30 along its front and rear lower edges (see FIG. 3), and does not require subsequent removal or replacement since it does not experience wear as a consequence of spring frog operation. Also, weld block component 20 is provided with integral, axially-opposed extension portions 32 and 34 which each function to retain or "capture" the head of the co-operating bolt fastener 16 or 18. To accomplish such function, each weld block extension portion is provided with an open-ended slot 36 or 38 and is configured so that its under surface is spaced-apart from base plate 30 by a sufficient distance to permit installation of the stem of the fastener being used to be fully inserted in its co-operating slot.

Figure 9:
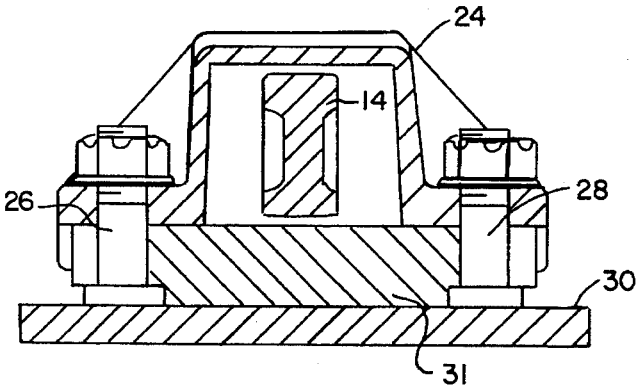
FIG. 9 is an elevational view similar to FIG. 2 illustrating a unitary weld block/riser component.

Replaceable riser element 22 in the hold-down construction has a planform that corresponds in size and shape to the plan form of weld block element 20. However, it is generally preferred that element 22 be fabricated of a steel alloy such as AISI 4130 that has greater wear resistance than the typical steel used for weld block element 20. Although in this preferred embodiment description riser component 22 is described and shown as a separate element, it should be noted that the riser and the weld block may be an integral component 31 as depicted in FIG. 9. Preferably integral riser/weld block component 31 is constructed of steel alloy (such as AISI 4130).

Figure 6:
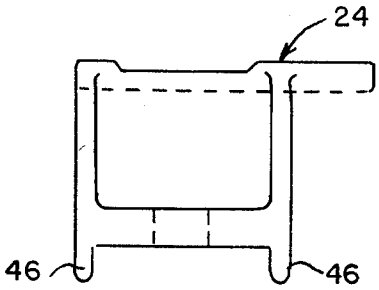
FIG. 6 is an end view of the cast housing component illustrated in FIGS. 1 through 3.
Figure 7:
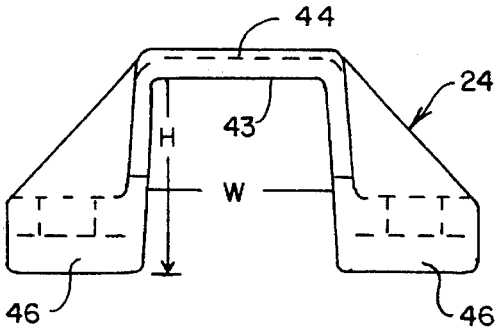
FIG. 7 is a side view of the cast housing component illustrated in FIGS. 1 through 3.
Figure 8:
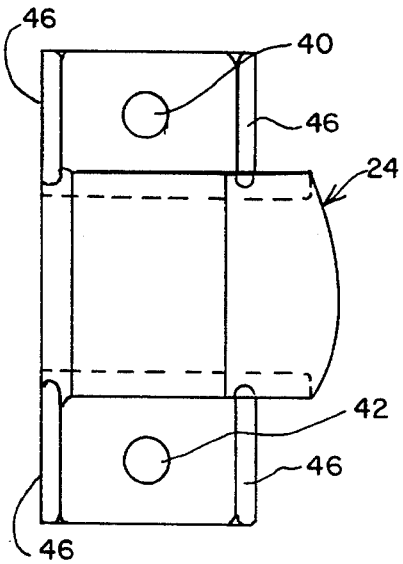
FIG. 8 is a plan view of the cast housing component illustrated in FIGS. 1 through 3.

Housing 24 shown in detail in FIGS. 6 through 8, is preferably cast of a ductile iron alloy such as ASTM A536 and is configured so that its fastener openings 40 and 42 register with slots 36 and 38 provided in the extension portions of weld block element 20 and in replaceable riser element 22. Basically, the height H of the integral bridge portion 44 of housing 24 is preferably only slightly greater than the corresponding height of the projected portion of horn fitting 14, and the width W of that bridge portion 44 is appreciably wider than the width of the co-operating horn fitting projection. Thus, restraint of horn fitting 14 by the housing hold-down during spring frog operation occurs only at the upper surface 21 of replaceable riser element 22 and at the under surface 43 of the bridge portion 44 of hold-down housing component 24. Also, it is important that cast housing component 24 be provided with the illustrated integral downward depending leg elements 46. Such leg elements overlie said riser element 22 and said weld block element 20 to assist in the proper alignment of the hold-down assembly during installation in the spring frog, and also provide an additional bearing surface for transmitting tipping or "pumping" loads from horn fitting component 14 into weld block component 20.

After assembly of housing component 24 vertically over fastener devices 26 and 28 and onto the weld block element 20—riser block element 22 combination, the installation is completed by properly tightening the castellated nut portions of bolt fasteners 26 and 28 and preferably securing those nut portions against unwanted rotation by appropriate cotter pin devices.

Various changes may be made in the relative shapes, sizes, and materials of the components of the herein-described hold-down invention without departing from the scope, meaning, or intent of the claims which follow.

We claim our invention as follows:

1. In a railroad trackwork spring frog installation having a base plate supporting a wing rail and a horn fitting attached to and projected laterally from the wing rail, in combination:

a weld block component welded to the installation base plate beneath and spaced-apart from the installation horn fitting;

a separate and replaceable riser component positioned beneath the installation horn fitting and removably supported on said weld block component;

a pair of bolt fastener devices retained in position by said weld block component;

a housing component positioned above the installation horn fitting and supported by the upper surface of said riser component; and said bolt fastener devices directly damping said weld block component, said riser component, and said housing component into a unitary structure having bearing surfaces that restrain the installation horn fitting from vertical movement but not from lateral movement during operation of the railroad trackwork spring frog.

2. The invention defined by claim 1 wherein said weld block component is provided with integral extensions having open-ended slot elements for receiving said bolt fastener devices and with undersurfaces that are spaced-apart from the installation base plate by a sufficient distance to accommodate the heads of said bolt fastener devices.

3. The invention defined by claim 1 wherein said weld block component and said riser component have conforming planforms, said planforms each including a pair of open-ended slot elements for receiving said bolt fastener devices.

4. The invention defined by claim 1 wherein said housing component is provided with a pair of downwardly depending leg elements which overlie said riser component and said weld block component.

5. The invention of claim 1 wherein said bolt fastener devices pass through said riser component.

6. In a railroad trackwork spring frog installation having a base plate supporting a wing rail and a horn fitting attached to and projected laterally from the wing rail, in combination:

a weld block component welded to the installation base plate beneath and spaced-apart from the installation horn fitting;

a riser component positioned beneath the installation horn fitting and supported on said weld block component;

a pair of bolt fastener devices retained in position by said weld block component;

a housing component positioned above the installation horn fitting and supported by the upper surface of said riser component;

said bolt fastener devices joining said weld block component, said riser component, and said housing component into a unitary structure having bearing surfaces that restrain the installation horn fitting from vertical movement but not from lateral movement during operation of the railroad trackwork spring frog; and wherein said weld block component and said riser component are fabricated of different steel alloys, the steel alloy of said riser component having a frictional wear resistance property significantly greater than the frictional wear resistance property of the steel alloy of said weld block component.

* * * * *